US010060450B2

(12) United States Patent
Udagawa et al.

(10) Patent No.: US 10,060,450 B2
(45) Date of Patent: Aug. 28, 2018

(54) HYDRAULIC CONTROL DEVICE FOR WORK MACHINE

(71) Applicant: Hitachi Construction Machinery Co., Ltd., Bunkyo-ku, Tokyo (JP)

(72) Inventors: Tsutomu Udagawa, Tsukuba (JP); Akira Nakayama, Tsuchiura (JP); Ryohei Yamashita, Tsuchiura (JP); Shiho Izumi, Hitachinaka (JP); Manabu Edamura, Kasumigaura (JP); Kouji Ishikawa, Kasumigaura (JP); Hidetoshi Satake, Ishioka (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 541 days.

(21) Appl. No.: 14/441,048

(22) PCT Filed: Nov. 5, 2013

(86) PCT No.: PCT/JP2013/079930
§ 371 (c)(1),
(2) Date: May 6, 2015

(87) PCT Pub. No.: WO2014/073541
PCT Pub. Date: May 15, 2014

(65) Prior Publication Data

US 2015/0300378 A1 Oct. 22, 2015

(30) Foreign Application Priority Data

Nov. 7, 2012 (JP) ..... 2012-245746

(51) Int. Cl.
*F15B 11/00* (2006.01)
*F15B 11/028* (2006.01)
(Continued)

(52) U.S. Cl.
CPC ..... *F15B 11/028* (2013.01); *E02F 3/32* (2013.01); *E02F 9/22* (2013.01); *E02F 9/2235* (2013.01);
(Continued)

(58) Field of Classification Search
CPC ..... F15B 2211/6652
See application file for complete search history.

(56) References Cited

U.S. PATENT DOCUMENTS 5,029,067 A * 7/1991 Nishida ..... E02F 9/2004 60/421
5,447,027 A 9/1995 Ishikawa et al.
(Continued)

FOREIGN PATENT DOCUMENTS

JP 3745038 B2 2/2006
JP 4096900 B2 6/2008
(Continued)

OTHER PUBLICATIONS

Korean-language Office Action issued in counterpart Korean Application No. 10-2015-7008351 dated Dec. 1, 2 016 (5 pages).
(Continued)

*Primary Examiner* — F. Daniel Lopez
(74) *Attorney, Agent, or Firm* — Crowell & Moring LLP

(57) ABSTRACT

The energy efficiency is increased by reducing the throttle/relief loss in the delivery flow of the hydraulic pump caused by the bleed-off control, while also making it possible to control the delivery pressure of the hydraulic pump according to the operation amount of the control lever unit and improving the operational performance. A controller 6 includes a target pump pressure setting unit 32 which calculates a target pump delivery pressure which increases with the increase in an operation amount signal from an operation amount detector 20A/20B based on the operation
(Continued)

amount signal and a pump flow rate upper limit setting unit 33 which calculates a pump flow rate upper limit which increases with the increase in the operation amount signal based on the operation amount signal. The tilt amount of the hydraulic pump 2 is controlled based on the target pump delivery pressure calculated by the target pump pressure setting unit 32, the pump flow rate upper limit calculated by the pump flow rate upper limit setting unit 33, and the delivery pressure of the hydraulic pump 2 detected by a pressure detector 21.

7 Claims, 12 Drawing Sheets

(51) Int. Cl.
*E02F 3/32* (2006.01)
*E02F 9/22* (2006.01)
*F15B 11/042* (2006.01)

(52) U.S. Cl.
CPC ..... *E02F 9/2285* (2013.01); *E02F 9/2296* (2013.01); *F15B 11/0423* (2013.01); *F15B 2211/20546* (2013.01); *F15B 2211/251* (2013.01); *F15B 2211/30525* (2013.01); *F15B 2211/3111* (2013.01); *F15B 2211/365* (2013.01); *F15B 2211/633* (2013.01); *F15B 2211/6309* (2013.01); *F15B 2211/6333* (2013.01); *F15B 2211/6346* (2013.01); *F15B 2211/6652* (2013.01); *F15B 2211/6653* (2013.01); *F15B 2211/6654* (2013.01)

(56) References Cited

U.S. PATENT DOCUMENTS

| | | | | |
|---|---|---|---|---|
| 6,308,516 | B1 * | 10/2001 | Kamada ..... | E02F 9/2228 60/450 |
| 2005/0204735 | A1 | 9/2005 | Sugano | |
| 2007/0204606 | A1 | 9/2007 | Imanishi et al. | |
| 2010/0154400 | A1 * | 6/2010 | Krajnik ..... | E02F 9/2235 60/327 |

FOREIGN PATENT DOCUMENTS

| | | | |
|---|---|---|---|
| JP | 4434159 | B2 | 3/2010 |
| JP | 2011-21694 | A | 2/2011 |
| JP | 2012-158932 | A | 8/2012 |
| KR | 0145144 | B1 | 8/1998 |

OTHER PUBLICATIONS

International Preliminary Report on Patentability (PCT/IB/338 & PCT/IB/373) dated May 21, 2015, including English translation of Document C2 (Japanese-language Written Opinion (PCT/ISA/237)) previously filed on May 6, 2015 (six (6) pages.
International Search Report (PCT/ISA/210) dated Dec. 24, 2013, with English translation (four (4) pages.
Japanese-language Written Opinion (PCT/ISA/237) dated Dec. 24, 2013 (three (3) pages).

* cited by examiner

HYDRAULIC CONTROL DEVICE FOR WORK MACHINE

TECHNICAL FIELD

The present invention relates to a hydraulic control device for a work machine such as a hydraulic excavator.

BACKGROUND ART

Hydraulic control devices of the bleed-off type have long been widely used as hydraulic control devices for conventional work machines. With this type of control system, a directional control valve for controlling the flow of hydraulic fluid delivered from a hydraulic pump to a hydraulic actuator is equipped with a bleed-off channel that is arranged in a bypass line. Such a bleed-off type hydraulic system controls the flow rate of the hydraulic fluid supplied to the actuator by performing the bleed-off control of returning part of the delivery flow of the hydraulic pump to a tank via the bleed-off channel according to the operation amount (stroke) of the directional control valve.

For such bleed-off type hydraulic systems, technological development is being conducted to reduce the flow returned to the tank via the bleed-off channel (bleed-off flow) from the viewpoint of increasing the energy efficiency (see Patent Literature 1, for example).

In the hydraulic system described in the Patent Literature 1, the delivery flow rate of the hydraulic pump is controlled by a controller by using a control valve (directional control valve) of the closed center type. With this configuration, bleed-off control equivalent to that performed by the control valve (directional control valve) equipped with the bleed-off channel is reproduced without the need of actually releasing part of the delivery flow of the hydraulic pump to the tank.

A hydraulic control device for a work machine is generally equipped with a relief valve for the purpose of protecting the hydraulic equipment. When the delivery pressure of the hydraulic pump driving a hydraulic actuator is about to exceed a preset pressure of the relief valve, the relief valve operates to return part of the delivery flow of the hydraulic pump to the tank, by which the delivery pressure of the hydraulic pump is prevented from exceeding the preset pressure of the relief valve. However, even in this case, the relief flow returning from the relief valve to the tank leads to energy loss. Therefore, technological development for reducing the relief flow is being carried out (see Patent Literatures 2 and 3, for example).

In the hydraulic system described in the Patent Literature 2, a pump flow rate command value is calculated in each of positive pump flow rate control, pressure feedback control and PQ control, and the delivery flow rate of the hydraulic pump is controlled by selecting one of the pump flow rate command values that most reduces the pump flow rate. Here, the "pressure feedback control" means control that calculates the pump flow rate command value based on the deviation of the delivery pressure of the hydraulic pump from a pressure set value (cutoff pressure control). By this control, the relief flow (loss) is reduced and the energy efficiency is increased even when the delivery pressure of the hydraulic pump rises sharply (e.g., when the swing structure of a hydraulic excavator is driven).

In the hydraulic system described in the Patent Literature 3, when the pump flow rate command value for the pressure feedback control has been selected in the hydraulic system of the Patent Literature 2, flow rate increasing control of increasing the flow rate command value with the passage of time is performed from the time of selection. By this control, sufficient driving force (turning/swinging force and hill-climbing force on slopes) is secured by increasing the delivery pressure of the hydraulic pump in the latter half of the pressure feedback control.

PRIOR ART LITERATURE

Patent Literature

Patent Literature 1: Japanese Patent No. 3745038
Patent Literature 2: Japanese Patent No. 4096900
Patent Literature 3: Japanese Patent No. 4434159

SUMMARY OF THE INVENTION

Problem to be Solved by the Invention

While the hydraulic system described in the Patent Literature 1 controls the delivery flow rate of the hydraulic pump with a controller by using a control valve (directional control valve) of the closed center type, the contents of the control are at most the reproduction of the bleed-off control and no further characteristic/performance improvement than the reproduction of the bleed-off control can be expected even though the throttle/relief loss in the delivery flow of the hydraulic pump caused by the bleed-off control by the directional control valve equipped with the bleed-off channel can be reduced For example, the excavation work performed with a hydraulic excavator is work in which the edge of the bucket is forced into the ground by rotating the arm in the crowding direction by the expansion of the arm cylinder and then earth and sand are scraped up into the bucket by the expansion of the bucket cylinder. The expanding operations of the arm cylinder and the bucket cylinder are conducted by the operator's lever operation on the control levers corresponding to the arm cylinder and the bucket cylinder. In the excavation work, if the excavating force can be adjusted properly by controlling the delivery pressure of the hydraulic pump according to the operation amount of the control lever unit, the excavation work is facilitated and the operational performance (operability for the operator, operational feel, working efficiency, etc.) is improved, which is highly convenient. However, the hydraulic system described in the Patent Literature 1 is incapable of performing such control since the delivery pressure of the hydraulic pump in the hydraulic system is not uniquely determined according to the operation amount of the control lever unit.

The hydraulic systems described in the Patent Literatures 2 and 3 also have similar problems since these hydraulic systems are similarly incapable of controlling the delivery pressure of the hydraulic pump according to the operation amount of the control lever unit.

The object of the present invention, which has been made in consideration of the above-described problems, is to provide a hydraulic control device for a work machine capable of increasing the energy efficiency by reducing the throttle/relief loss in the delivery flow of the hydraulic pump caused by the bleed-off control, while also making it possible to control the delivery pressure of the hydraulic pump according to the operation amount of the control lever unit and improving the operational performance.

Means for Solving the Problem (1) To achieve the above object, the present invention provides a hydraulic control device for a work machine, comprising: a prime mover; a hydraulic pump of the variable displacement type which is driven by the prime mover; a hydraulic actuator which is driven by hydraulic fluid delivered from the hydraulic pump; a directional control valve which controls the flow of the hydraulic fluid supplied from the hydraulic pump to the hydraulic actuator; a control lever unit through which an operator inputs operation commands; an operation amount detector which detects the operation amount of the control lever unit; a pressure detector which detects the delivery pressure of the hydraulic pump; and a pump control device which controls a tilt amount of the hydraulic pump. The pump control device includes: a target pump pressure setting unit which calculates a target pump delivery pressure which increases with the increase in an operation amount signal from the operation amount detector based on the operation amount signal from the operation amount detector; a pump flow rate upper limit setting unit which calculates a pump flow rate upper limit which increases with the increase in the operation amount signal from the operation amount detector based on the operation amount signal from the operation amount detector; and a tilt amount control unit which controls the tilt amount of the hydraulic pump based on the target pump delivery pressure calculated by the target pump pressure setting unit, the pump flow rate upper limit calculated by the pump flow rate upper limit setting unit and the delivery pressure of the hydraulic pump detected by the pressure detector.

As above, in the present invention, the tilt amount control unit controls the tilt amount of the hydraulic pump based on the pump flow rate upper limit calculated by the pump flow rate upper limit setting unit. By this control, the throttle/relief loss in the delivery flow of the hydraulic pump caused by the bleed-off control can be reduced and the energy efficiency can be increased. Further, the tilt amount control unit controls the tilt amount of the hydraulic pump based on the target pump delivery pressure calculated by the target pump pressure setting unit and the delivery pressure of the hydraulic pump detected by the pressure detector. This makes it possible to control the delivery pressure of the hydraulic pump according to the operation amount of the control lever unit and to improve the operational performance.

(2) Preferably, the hydraulic control device (1) for a work machine further comprises a prime mover revolution detector which detects the revolution speed of the prime mover. The pump control device further includes a revolution speed correction unit which calculates a pump tilt upper limit by correcting the pump flow rate upper limit calculated by the pump flow rate upper limit setting unit by use of the revolution speed of the prime mover detected by the prime mover revolution detector. The tilt amount control unit includes a control amount limitation unit which limits the upper limit of the tilt amount of the hydraulic pump based on the pump tilt upper limit calculated by the revolution speed correction unit.

As above, in the present invention, the upper limit of the tilt amount of the hydraulic pump is limited based on the pump tilt upper limit calculated by correcting the pump flow rate upper limit by use of the revolution speed of the prime mover. By the limitation, the control is performed so that the upper limit of the delivery flow rate of the hydraulic pump constantly equals the calculated pump flow rate upper limit even when the revolution speed of the prime mover changes. This enables precise delivery flow rate control of the hydraulic pump according to the operation amount of the control lever unit.

(3) Preferably, the hydraulic control device (1) or (2) for a work machine further comprises: a pump power upper limit setting device which sets a power limit value for limiting the absorption power of the hydraulic pump; a flow rate upper limit correction unit which calculates a pump flow rate upper limit by correcting the power limit value set by the pump power upper limit setting device by use of the delivery pressure of the hydraulic pump detected by the pressure detector; and a selection unit which compares the pump flow rate upper limit calculated by the pump flow rate upper limit setting unit with the pump flow rate upper limit calculated by the flow rate upper limit correction unit and selects the lower value from the two pump flow rate upper limits. The tilt amount control unit controls the tilt amount of the hydraulic pump based on the pump flow rate upper limit selected by the selection unit.

As above, in the present invention, the tilt amount of the hydraulic pump is controlled by selecting the lower value from the pump flow rate upper limit calculated by the pump flow rate upper limit setting unit and the pump flow rate upper limit calculated by the flow rate upper limit correction unit. This makes it possible to perform the control while incorporating the power limit value of the hydraulic pump into the limitation, by which the operational performance of the system can be improved further.

(4) Preferably, in the hydraulic control device (3) for a work machine, the pump power upper limit setting device is configured to allow the operator to change the power limit value by operating an operating device.

With this configuration, the operator is allowed to freely set the power limit value according to his/her intention. Consequently, the operational performance of the system can be improved further.

(5) Preferably, in any one of the hydraulic control devices (1)-(3) for a work machine, the target pump pressure setting unit is configured to have multiple target pump pressure characteristics preset therein and to allow the operator to select a desired one of the target pump pressure characteristics by operating an operating device.

With this configuration, the operator is allowed to freely adjust the target pump pressure characteristic according to his/her intention. Consequently, the operational performance is improved further.

(6) Preferably, in any one of the hydraulic control devices (1)-(3) for a work machine, the pump flow rate upper limit setting unit is configured to have multiple pump flow rate upper limit characteristics preset therein and to allow the operator to select a desired one of the pump flow rate upper limit characteristics by operating an operating device.

With this configuration, the operator is allowed to freely adjust the characteristic of the pump flow rate upper limit according to his/her intention. Consequently, the operational performance is improved further.

(7) Preferably, in any one of the hydraulic control devices (1)-(3) for a work machine, the target pump pressure setting unit and the pump flow rate upper limit setting unit have: a high power mode in which a characteristic in which the target pump pressure with respect to the operation amount signal in the target pump pressure setting unit is set at a high set value is combined with a characteristic in which the pump flow rate upper limit with respect to the operation amount signal in the pump flow rate upper limit setting unit is set at a high set value; a standard mode in which a characteristic in which the target pump pressure with respect to the operation amount signal in the target pump pressure setting unit is set at an intermediate set value is combined with a characteristic in which the pump flow rate upper limit with respect to the operation amount signal in the pump flow rate upper limit setting unit is set at an intermediate set value; and a fine operation mode in which a characteristic in which the target pump pressure with respect to the operation amount signal in the target pump pressure setting unit is set at a low set value is combined with a characteristic in which the pump flow rate upper limit with respect to the operation amount signal in the pump flow rate upper limit setting unit is set at a low set value. The hydraulic control device is configured to allow the operator to select a desired mode by operating an operating device.

With this configuration, in the situation in which there are a lot of combinations of characteristics of the target pump pressure setting unit and the pump flow rate upper limit setting unit, the operator is allowed to make the complicated settings just by making a selection from some typical combinations (modes). Thus, the operation for selecting a combination is simplified, the workload on the operator is reduced, and the usability is improved.

(8) Preferably, any one of the hydraulic control devices (1)-(3) for a work machine may be configured to further comprise a main relief valve which is connected to a pump delivery hydraulic line connecting the hydraulic pump to the directional control valve and prescribes the upper limit of the pressure in the pump delivery hydraulic line. The target pump pressure setting unit is configured to set a pressure Ppmax1 lower than opening pressure of the main relief valve or a pressure Ppmax2 higher than the opening pressure of the main relief valve as the maximum pressure of the target pump pressure. The hydraulic control device is configured to allow the operator to select one of the pressures Ppmax1 and Ppmax2 by operating an operating device.

With this configuration, in normal use, the maximum delivery pressure of the hydraulic pump can be made lower than the cracking pressure of the main relief valve by setting the pressure Ppmax1 in the target pump pressure setting unit as the maximum pressure of the target pump pressure. This setting reduces the energy loss due to the opening of the main relief valve and increases the energy efficiency. In low temperature conditions or the like, the maximum delivery pressure of the hydraulic pump can be made higher than the cracking pressure of the main relief valve by setting the pressure Ppmax2 in the target pump pressure setting unit as the maximum pressure of the target pump pressure. With this setting, the delivery pressure of the hydraulic pump reaches the relief pressure, part of the delivery flow of the hydraulic pump is released through the main relief valve and converted into heat, and the hydraulic fluid can be warmed up.

(9) Preferably, in any one of the hydraulic control devices (1)-(3) for a work machine, the pump control device is configured by assigning functions other than the tilt amount control unit to a controller and assigning the function of the tilt amount control unit to a mechanical regulator.

With this configuration, high-responsiveness high-precision control such as the pressure control is carried out by the mechanical regulator. Therefore, control with high responsiveness can be achieved even if the controller does not have high performance necessary for high-speed control calculation. Further, the configuration is desirable since the degree of freedom of combination of components is increased and the system configuration is facilitated.

Effect of the Invention

According to the present invention, the energy efficiency is increased by reducing the throttle/relief loss in the delivery flow of the hydraulic pump caused by the bleed-off control, while also making it possible to control the delivery pressure of the hydraulic pump according to the operation amount of the control lever unit and improving the operational performance.

MODE FOR CARRYING OUT THE INVENTION

Figure 1:
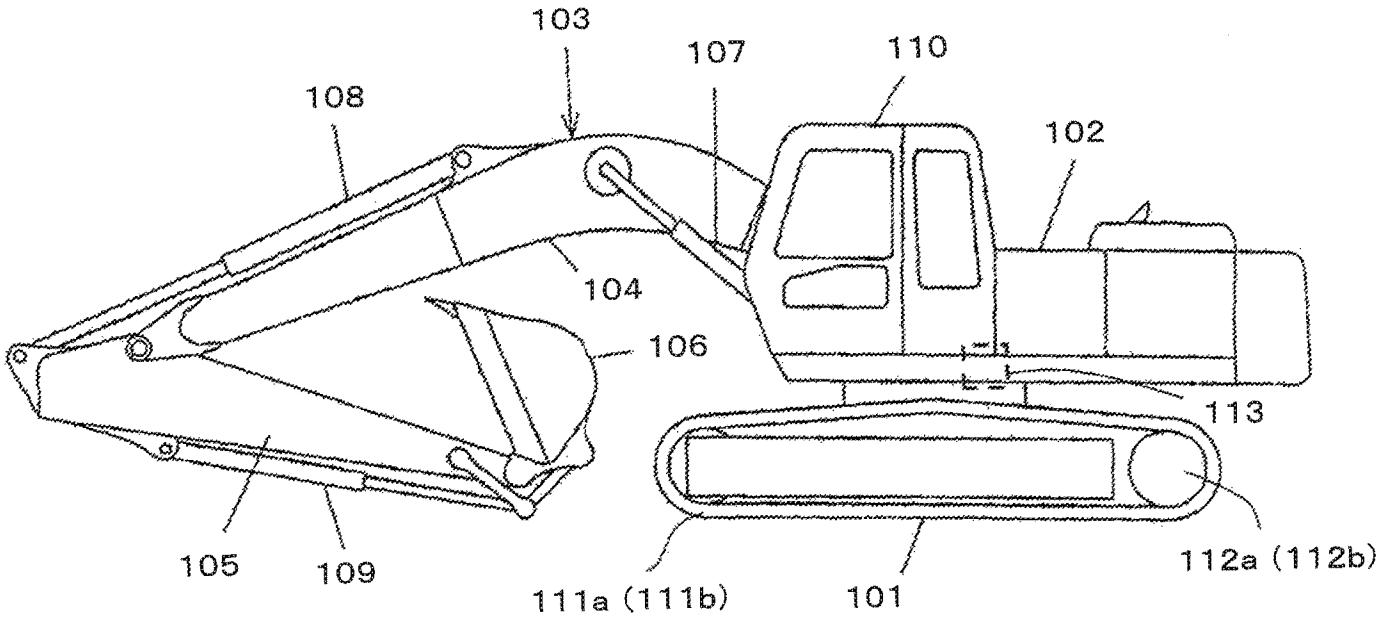
FIG. 1 is a side view showing a hydraulic excavator as an example of a work machine equipped with a hydraulic control device in accordance with the present invention.

Referring now to the drawings, a description will be given in detail of preferred embodiments in accordance with the present invention.

FIG. 1 is a side view showing a hydraulic excavator as an example of a work machine equipped with a hydraulic control device in accordance with the present invention.

The hydraulic excavator shown in FIG. 1 comprises a track structure 101, a swing structure 102 which is arranged on the track structure 101, and a work device (front work implement) 103 which is attached to the swing structure 102. The swing structure 102 includes a cab 110. Arranged in the cab 110 are a cab seat for the operator and operating devices to be operated by the operator (e.g., control lever unit 5 (see FIG. 2)). The work device 103 includes a boom 104 which is attached to the swing structure 102 to be vertically rotatable, an arm 105 which is attached to the tip end of the boom to be vertically rotatable, and a bucket 106 which is attached to the tip end of the arm 105 to be vertically rotatable.

The track structure 101 includes left and right crawlers 111*a* and 111*b* and left and right travel motors 112*a* and 112*b* for driving the left and right crawlers for the traveling of the hydraulic excavator. The swing structure 102 includes a swing motor 113 which drives a swing wheel (unshown) and thereby rotates the swing structure 102 with respect to the track structure 101. The work device 103 includes a boom cylinder 107 for actuating the boom 104, an arm cylinder 108 for actuating the arm 105, and a bucket cylinder 109 for actuating the bucket 106.

First Embodiment

Figure 2:
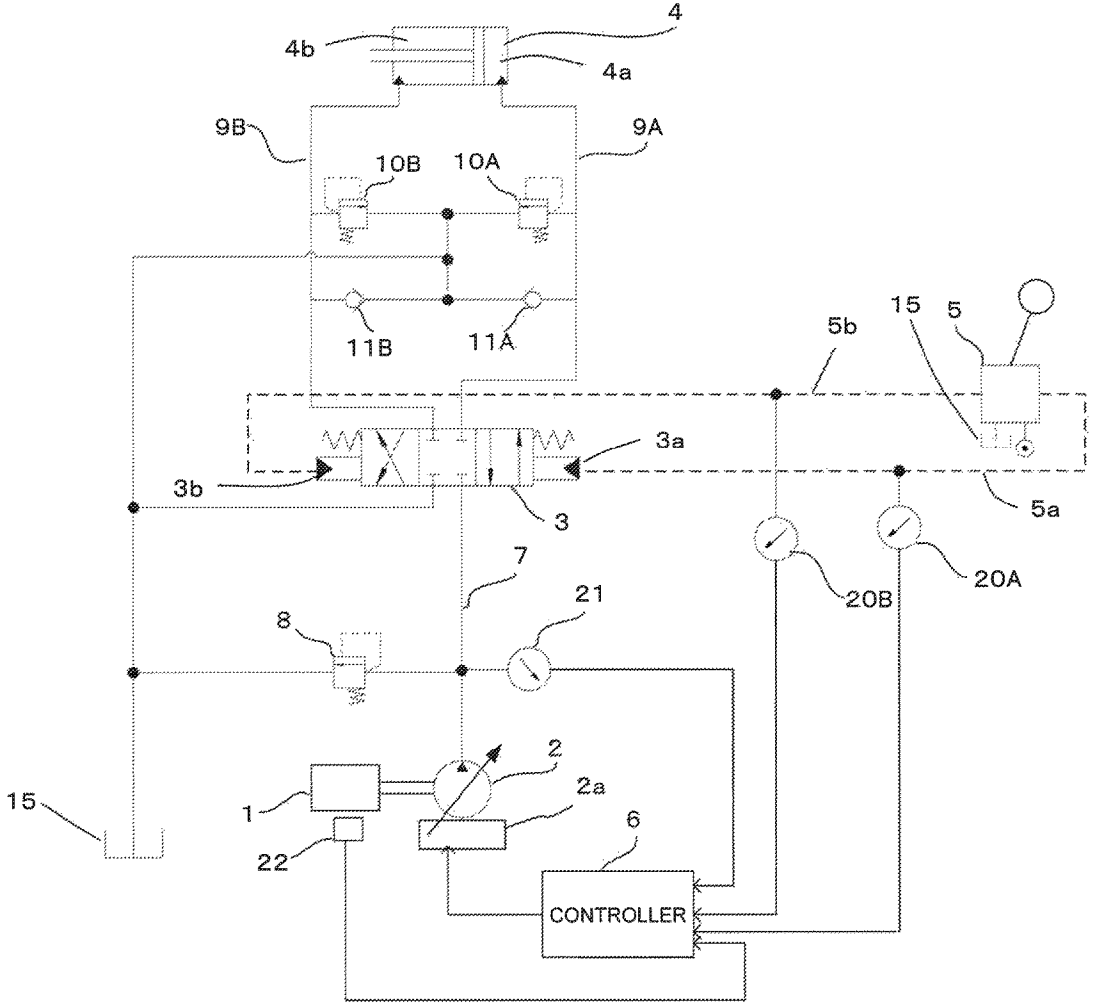
FIG. 2 is a schematic diagram showing a part of the hydraulic control device in accordance with a first embodiment of the present invention.

FIG. 2 is a schematic diagram showing a part of the hydraulic control device in accordance with a first embodiment of the present invention.

The hydraulic control device of this embodiment comprises a prime mover 1 (e.g., diesel engine), a hydraulic pump 2 of the variable displacement type which is driven by the prime mover 1, a hydraulic actuator 4 which is driven by hydraulic fluid delivered from the hydraulic pump 2, a directional control valve 3 which controls the flow of the hydraulic fluid supplied from the hydraulic pump 2 to the hydraulic actuator 4, a control lever unit 5 through which the operator inputs operation commands, a main relief valve 8 which is connected to a pump delivery hydraulic line 7 connecting the hydraulic pump 2 to the directional control valve 3 and prescribes the upper limit of the pressure in the pump delivery hydraulic line 7 (i.e., delivery pressure of the hydraulic pump 2), and a tank 15 which is connected to the hydraulic pump 2, the directional control valve 3, the main relief valve 8, and so forth.

The hydraulic pump 2 is a swash plate pump of the variable displacement type, for example. The hydraulic pump 2 includes a regulator 2*a* which changes the delivery flow rate by changing the tilt amount of a swash plate.

The directional control valve 3 is a valve of the closed type which blocks up the pump delivery hydraulic line 7 when the valve is set at a neutral position. Pressure-receiving parts 3*a* and 3*b* are arranged at both ends of the spool of the directional control valve 3. The pressure-receiving parts 3*a* and 3*b* are connected to the control lever unit 5 via pilot hydraulic lines 5*a* and 5*b*, respectively. Operation pilot pressure from the control lever unit 5 is lead to the pressure-receiving part 3*a* or 3*b*, by which the directional control valve 3 is switched from the neutral position to an operating position on the left side or right side in FIG. 2.

The hydraulic actuator 4 is an actuator representing one of the boom cylinder 107, the arm cylinder 108, the bucket cylinder 109, the left travel motor 112*a*, the right travel motor 112*b* and the swing motor 113 of the hydraulic excavator described above. Preferably, the hydraulic actuator 4 is one of the boom cylinder 107, the arm cylinder 108 and the bucket cylinder 109 as a hydraulic actuator of the work device 103.

One of two actuator ports of the directional control valve 3 is connected to a bottom-side chamber 4*a* of the hydraulic actuator (hereinafter referred to also as a "hydraulic cylinder") 4 via a hydraulic line 9A. The other actuator port of the directional control valve 3 is connected to a rod-side chamber 4*b* of the hydraulic cylinder 4 via a hydraulic line 9B. Overload relief valves 10A and 10B and supply check valves 11A and 11B are arranged between the hydraulic lines 9A and 9B.

The hydraulic control device further comprises operation amount detectors 20A and 20B for detecting the operation amount of the control lever unit 5, a pressure detector 21 for detecting the delivery pressure of the hydraulic pump 2, a revolution detector 22 for detecting the revolution speed of the prime mover 1, and a controller 6 for controlling the tilt amount of the hydraulic pump 2. The operation amount detectors 20A and 20B are pressure detectors for detecting the pressures in the pilot hydraulic lines 5*a* and 5*b* (operation pilot pressures). The operation amount detectors 20A and 20B may also be implemented by a position detector that detects the lever stroke of the control lever unit 5.

Figure 3:
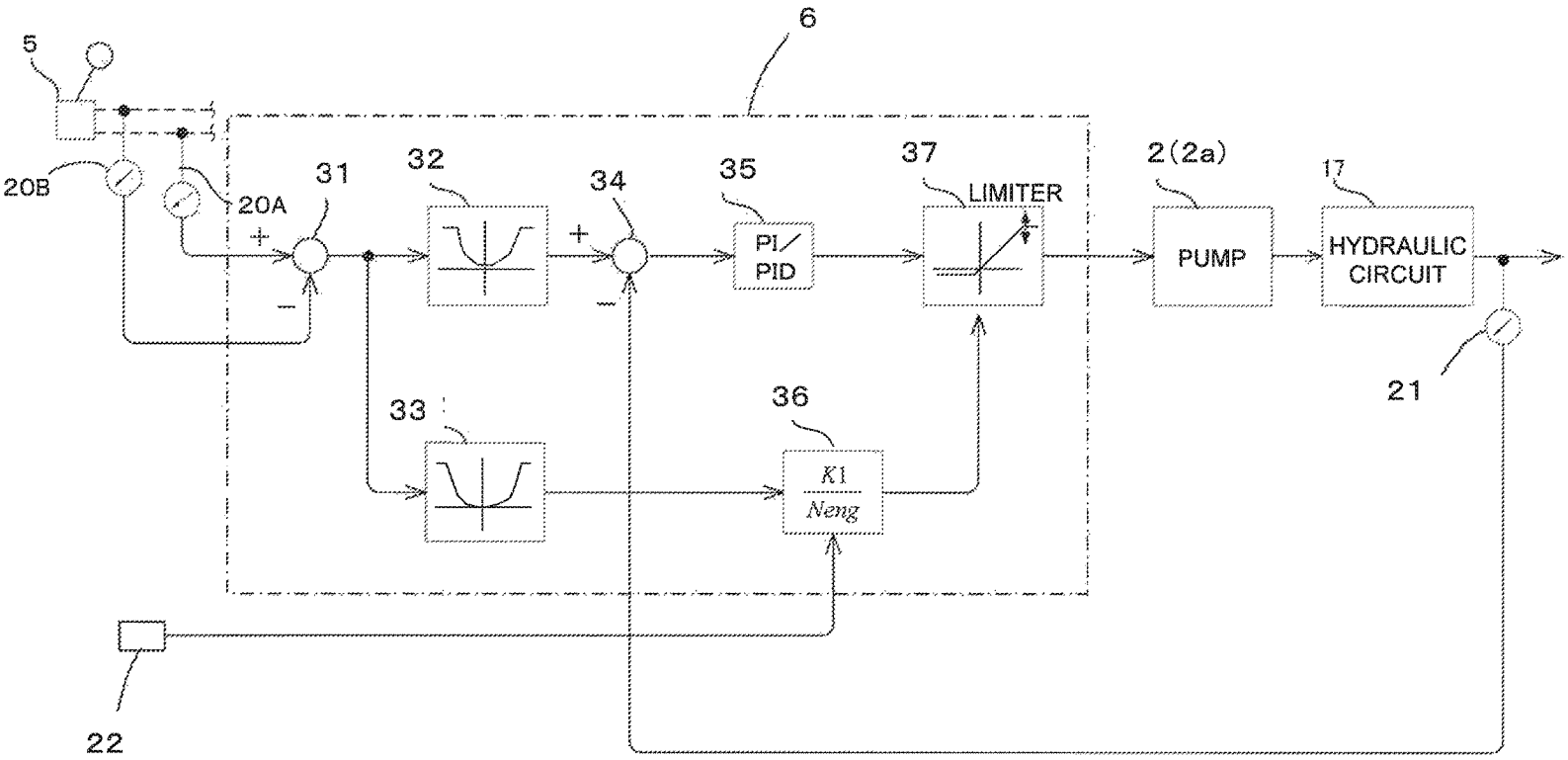
FIG. 3 is a schematic diagram showing the control logic of a controller in the first embodiment.

FIG. 3 is a schematic diagram showing the control logic of the controller 6.

The controller 6 includes an operation amount detection unit 31, a target pump pressure setting unit 32, a pump flow rate upper limit setting unit 33, a feedback subtraction unit 34, a control amount calculation unit 35, a revolution speed correction unit 36 and a limiter (control amount limitation unit) 37. The operation amount detection unit 31 is implemented by a subtracter which receives an operation amount signal from the operation amount detector 20A/20B and outputs the operation amount signal from the operation amount detector 20A as a positive value while outputting the operation amount signal from the operation amount detector 20B as a negative value. In the target pump pressure setting unit 32, the relationship between the operation amount signal from the operation amount detector 20A/20B and a target pump pressure has previously been set. The target pump pressure setting unit 32 calculates a corresponding target pump pressure based on the operation amount signal from the operation amount detection unit 31. In the pump flow rate upper limit setting unit 33, the relationship between the operation amount signal from the operation amount detector 20A/20B and a pump flow rate upper limit has previously been set. The pump flow rate upper limit setting unit 33 calculates a corresponding pump flow rate upper limit based on the operation amount signal from the operation amount detection unit 31. The feedback subtraction unit 34 calculates a pressure deviation $\Delta P$ by subtracting the delivery pressure of the hydraulic pump 2 detected by the pressure detector 21 from the target pump pressure calculated by the target pump pressure setting unit 32. The control amount calculation unit 35 calculates a target tilt amount of the hydraulic pump 2 by performing PI/PID calculation on the pressure deviation $\Delta P$ calculated by the feedback subtraction unit 34. The revolution speed correction unit 36 calculates a pump tilt upper limit by correcting the pump flow rate upper limit (calculated by the pump flow rate upper limit setting unit 33) based on the revolution speed of the prime mover 1 detected by the revolution detector 22. Specifically, the revolution speed correction unit 36 calculates the pump tilt upper limit by dividing the pump flow rate upper limit by the revolution speed Neng of the prime mover 1 and multiplying the quotient by a correction coefficient K1. The limiter (control amount limitation unit) 37 limits the upper limit of the target tilt amount (calculated by the control amount calculation unit 35) to the pump tilt upper limit calculated by the revolution speed correction unit 36, while limiting the lower limit of the target tilt amount to a negative minute constant value. The value obtained by the limiter 37 is outputted as a tilt command for the regulator 2*a* of the hydraulic pump 2.

In this example, the feedback subtraction unit 34 and the control amount calculation unit 35 constitute a control amount calculation unit which calculates the target tilt amount for making the delivery pressure of the hydraulic pump 2 (detected by the pressure detector 21) coincide with the target pump pressure calculated by the target pump pressure setting unit 32.

The feedback subtraction unit 34, the control amount calculation unit 35, the limiter 37, and the regulator 2*a* of the hydraulic pump 2 constitute a tilt amount control unit which controls the tilt amount of the hydraulic pump 2 based on the target pump pressure calculated by the target pump pressure setting unit 32, the pump flow rate upper limit calculated by the pump flow rate upper limit setting unit 33 and the delivery pressure of the hydraulic pump 2 detected by the pressure detector 21 so that the delivery pressure of the hydraulic pump 2 equals the target pump pressure until the delivery flow rate of the hydraulic pump 2 reaches the pump flow rate upper limit and so that the delivery flow rate of the hydraulic pump 2 does not exceed the pump flow rate upper limit after the delivery flow rate has reached the pump flow rate upper limit.

Figure 3A:
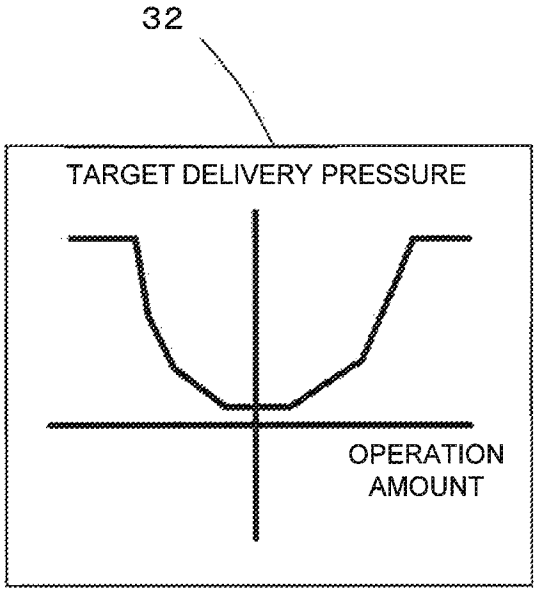
FIG. 3A is a graph showing the relationship between an operation amount signal and target pump pressure which is set in a target pump pressure setting unit.

FIG. 3A is a graph showing the relationship between the operation amount signal and the target pump pressure which is set in the target pump pressure setting unit 32.

As shown in FIG. 3A, the target pump pressure setting unit 32 has been preset so that the delivery pressure of the hydraulic pump 2 increases with the increase in the operation amount signal from the operation amount detector 20A/20B (i.e., the operation amount of the control lever unit 5). The target pump pressure setting unit 32 is configured so as to secure the maximum circuit pressure when the control lever unit 5 is around or over a maximum lever operation position and so as to suppress the circuit pressure to a low level (or to suppress the circuit pressure to 0) when the control lever unit 5 is around its neutral position.

From the viewpoint of increasing the energy efficiency, the maximum circuit pressure, which is secured when the control lever unit 5 is around or over the maximum lever operation position, has been set lower than the opening pressure (cracking pressure) of the main relief valve 8 which limits the delivery pressure of the hydraulic pump 2. With this setting, the limitation on the circuit pressure is conducted basically by the control of the delivery flow rate of the hydraulic pump 2 based on the setting by the target pump pressure setting unit 32. Therefore, energy loss due to the opening of the main relief valve 8 decreases and the energy efficiency increases.

Figure 3B:
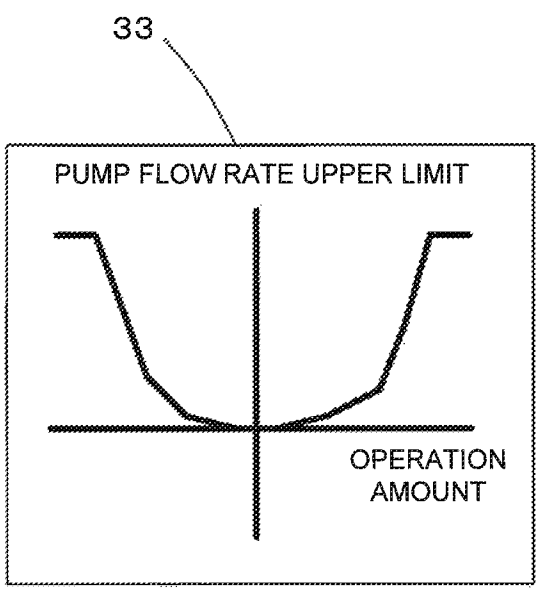
FIG. 3B is a graph showing the relationship between the operation amount signal and a pump flow rate upper limit which is set in a pump flow rate upper limit setting unit.

FIG. 3B is a graph showing the relationship between the operation amount signal and the pump flow rate upper limit which is set in the pump flow rate upper limit setting unit 33.

As shown in FIG. 3B, the pump flow rate upper limit setting unit 33 has been preset so that the delivery flow rate of the hydraulic pump 2 increases with the increase in the operation amount signal from the operation amount detector 20A/20B (i.e., the operation amount of the control lever unit 5). The pump flow rate upper limit setting unit 33 is configured so as to secure the maximum flow rate when the control lever unit 5 is around or over the maximum lever operation position and so as to suppress the pump flow rate upper limit to a low level when the control lever unit 5 is around its neutral position.

In operations like the driving of the work device 103 by a hydraulic cylinder, the push operation and the pull operation of the control lever of the control lever unit 5 is often required to have asymmetrical and different characteristics with respect to the neutral position. Thus, a characteristic suitable for the operating direction of the control lever unit 5 can be achieved by previously setting characteristics (with respect to the operation amount signal from the operation amount detector 20A and the operation amount signal from the operation amount detector 20B) corresponding to the different characteristics to the target pump pressure setting unit 32 and the pump flow rate upper limit setting unit 33.

Figure 3C:
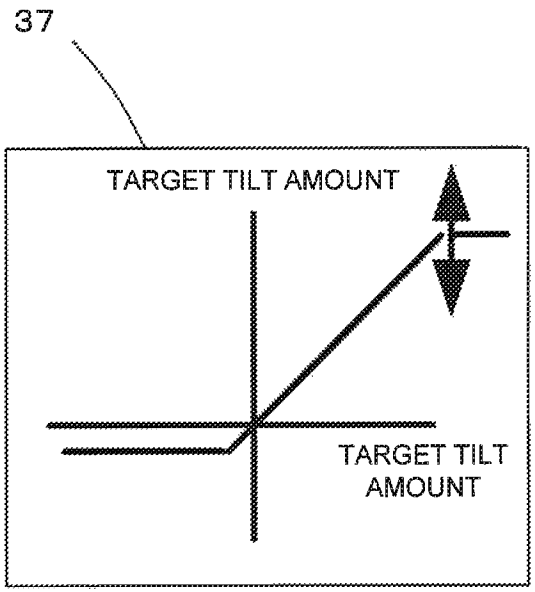
FIG. 3C is a graph showing the relationship between a target tilt amount and a limit value which is set in a limiter and the change in the target tilt amount limit value due to a pump tilt upper limit calculated by a revolution speed correction unit.

FIG. 3C is a graph showing the relationship between the target tilt amount and a limit value which is set in the limiter 37 and the change in the target tilt amount limit value due to the pump tilt upper limit calculated by the revolution speed correction unit 36.

As shown in FIG. 3C, the relationship between the target tilt amount calculated by the control amount calculation unit 35 and the target tilt amount limit value has been set in the limiter 37 so that the upper limit of the target tilt amount is limited to the pump tilt upper limit calculated by the revolution speed correction unit 36 and the lower limit of the target tilt amount is limited to a negative minute constant value. The upper limit of the target tilt amount is limited to the pump tilt upper limit calculated by the revolution speed correction unit 36 in order to adjust the maximum delivery flow rate of the hydraulic pump 2 according to the operation amount of the control lever unit 5 (demanded flow rate). The lower limit of the target tilt amount is limited to a negative minute constant value in order to suppress the increase in the delivery pressure of the hydraulic pump 2 when the control lever unit 5 is not operated (i.e., when the lever is at the neutral position) by allowing the hydraulic fluid in the pump delivery hydraulic line 7 to return to the tank 15.

Next, the operation will be explained below.

Figure 4:
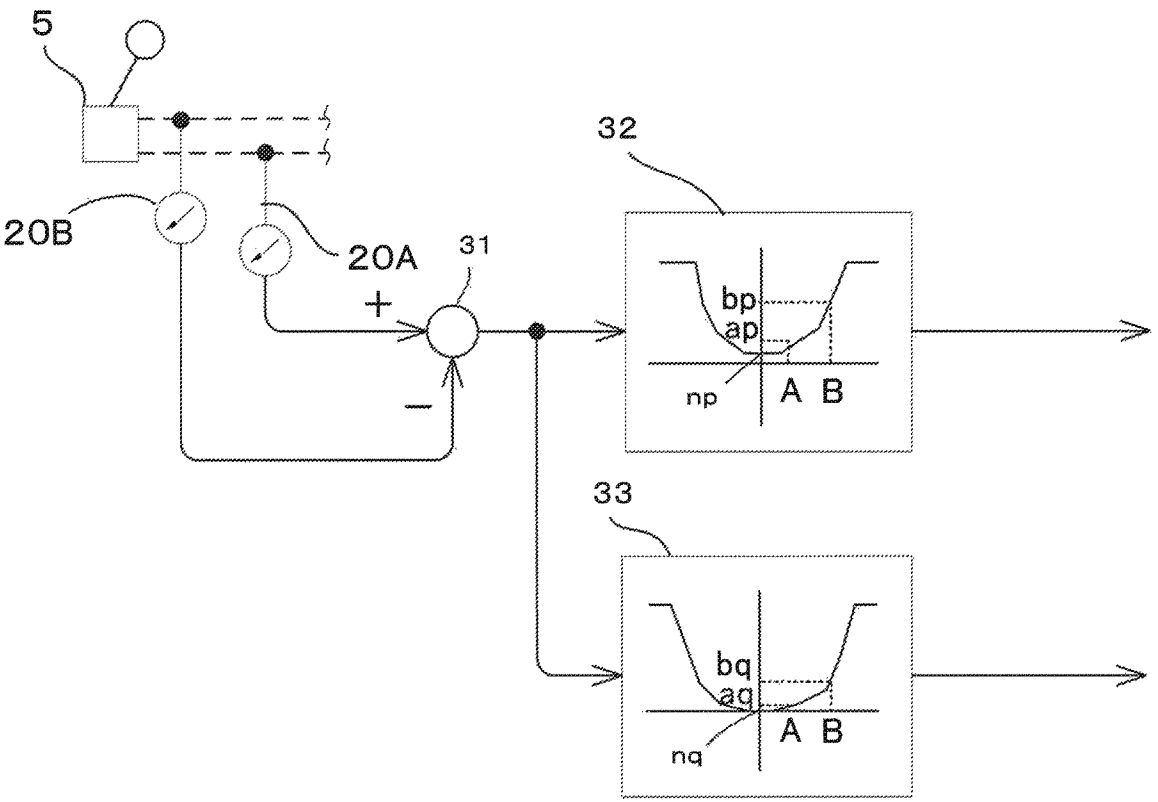
FIG. 4 is a schematic diagram comprehensibly showing calculations performed by the target pump pressure setting unit and the pump flow rate upper limit setting unit according to a lever input to a control lever unit (operation amount).
Figure 5:
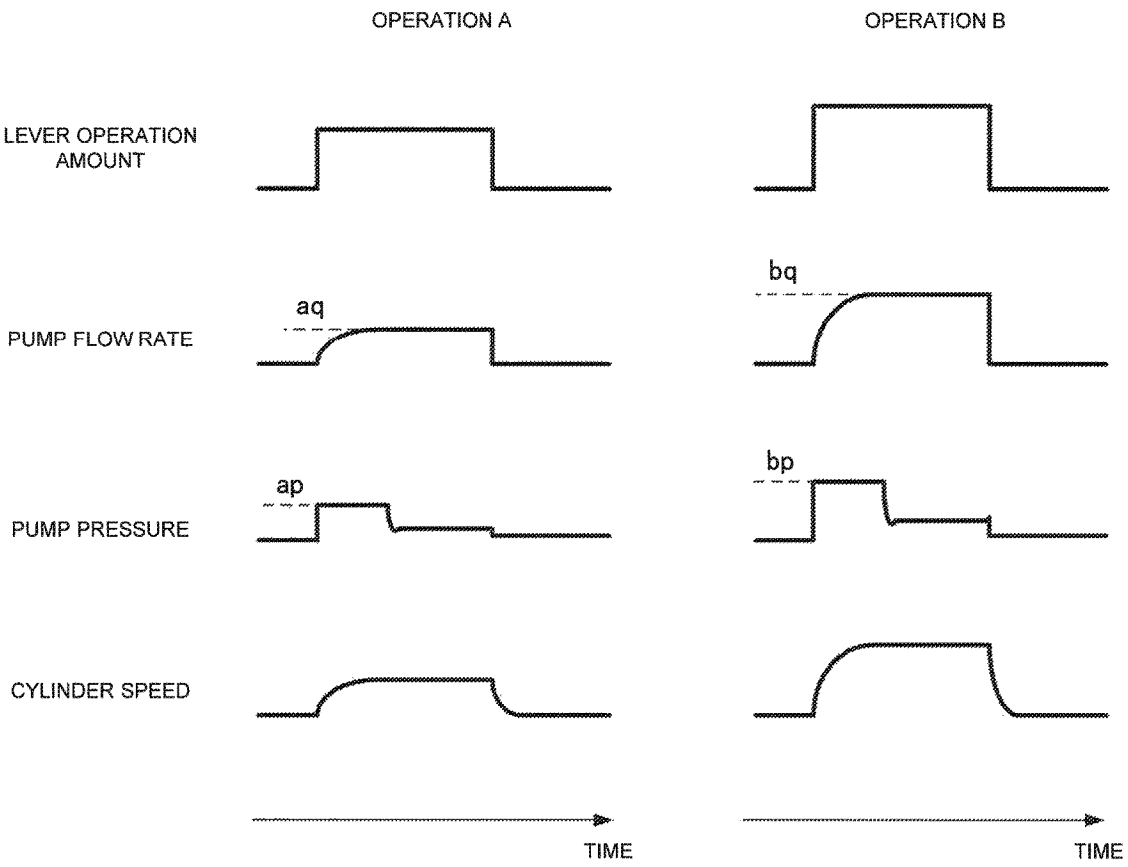
FIG. 5 is a schematic diagram for explaining the lever input (operation amount) and a delivery flow rate of a hydraulic pump (pump flow rate), delivery pressure of the hydraulic pump (pump pressure) and driving speed of a hydraulic cylinder (cylinder speed) in response to the lever input.

The following explanation of the operation will be given in regard to a case where the operator's lever input to the control lever unit 5 (operation amount) is neutral, a case where the lever input is slight (operation A), and a case where the lever input is greater than that in the operation A (operation B). FIG. 4 is a schematic diagram comprehensibly showing the calculations performed by the target pump pressure setting unit 32 and the pump flow rate upper limit setting unit 33 according to the lever input to the control lever unit 5 (operation amount). FIG. 5 is a schematic diagram for explaining the lever input (operation amount) in each case and the delivery flow rate of the hydraulic pump 2 (pump flow rate), the delivery pressure of the hydraulic pump 2 (pump pressure) and the driving speed of the hydraulic cylinder 4 (cylinder speed) in response to the lever input.

First, when the lever input to the control lever unit 5 is neutral, the operator's operation amount is 0 and a low value np is outputted from the target pump pressure setting unit 32 as the result of the calculation of the target pump pressure. Further, the delivery pressure of the hydraulic pump 2 detected by the pressure detector 21 is fed back (feedback subtraction unit 34) and the target tilt amount for setting the pump pressure at the target pump pressure is calculated (control amount calculation unit 35). Meanwhile, a low value nq is outputted from the pump flow rate upper limit setting unit 33 as the result of the calculation of the pump flow rate upper limit ($nq \cong 0$ in the illustrated example), and the pump tilt upper limit is determined by correcting the value by use of the revolution speed of the prime mover 1 detected by the revolution detector 22 (revolution speed correction unit 36). Limiter processing is performed by the limiter 37 on the aforementioned target tilt amount by use of the pump tilt upper limit, by which the tilt command for the regulator 2*a* of the hydraulic pump 2 is calculated and the tilt amount of the hydraulic pump 2 is controlled. On the other hand, the directional control valve 3 shown in FIG. 2 is at its neutral position, and thus the delivery flow from the hydraulic pump 2 is blocked by the directional control valve 3. Since the hydraulic lines 9A and 9B are closed in this case, the hydraulic cylinder 4 does not operate and the stopped state is maintained. The pressure in the pump delivery hydraulic line 7 begins to rise since the delivery flow from the hydraulic pump 2 is blocked by the directional control valve 3. However, the value calculated by the limiter 37 turns into the lower limit (negative minute constant value) when the pressure deviation for the feedback control becomes negative, and thus the hydraulic pump 2 operates so as to set the tilt amount slightly lower than 0, that is, so as to suck in the hydraulic fluid from the pump delivery hydraulic line 7 and return the hydraulic fluid to the tank 15. Consequently, the pressure rise in the pump delivery hydraulic line 7 (i.e., the increase in the delivery pressure of the hydraulic pump 2) is suppressed. In cases where the neutral state continues for a long time (e.g., when the operation by the hydraulic excavator is interrupted), the pressure in the pump delivery hydraulic line 7 can become negative and cavitation can occur. In order to reduce the probability of occurrence of cavitation, a make-up valve (unshown) may be provided between the pump delivery hydraulic line 7 and the tank 15.

Next, in the operation A in which the input to the control lever unit 5 is slight, the operator's operation amount is slight and a relatively low value ap (higher than the value np) is outputted from the target pump pressure setting unit 32 as the result of the calculation of the target pump pressure. Further, the delivery pressure of the hydraulic pump 2 detected by the pressure detector 21 is fed back (feedback subtraction unit 34) and the target tilt amount for setting the pump pressure at the target pump pressure ap is calculated (control amount calculation unit 35). Meanwhile, a relatively low value aq (higher than the value nq) is outputted from the pump flow rate upper limit setting unit 33 as the result of the calculation of the pump flow rate upper limit, and the pump tilt upper limit is determined by correcting the value by use of the revolution speed of the prime mover 1 detected by the revolution detector 22 (revolution speed correction unit 36). The limiter processing is performed by the limiter 37 on the aforementioned target tilt amount by use of the pump tilt upper limit, by which the tilt command for the regulator 2*a* of the hydraulic pump 2 is calculated and the tilt amount of the hydraulic pump 2 is controlled. On the other hand, the directional control valve 3 shown in FIG. 2 has shifted from the neutral position even though the shift amount is slight, and thus the delivery flow from the hydraulic pump 2 flows through the meter-in throttle of the directional control valve 3 and is lead to the bottom-side chamber 4*a* of the hydraulic cylinder 4 via the hydraulic line 9A. The hydraulic fluid discharged from the rod-side chamber 4*b* of the hydraulic cylinder 4 flows through the hydraulic line 9B, flows through the meter-out throttle of the directional control valve 3, and is discharged to the tank 15.

In this case, the pump flow rate, the pump pressure and the cylinder speed change as shown in the column "OPERATION A" in FIG. 5 in response to the lever input. Specifically, the pump flow rate is controlled at a flow rate corresponding to the pump flow rate upper limit aq of the hydraulic cylinder 4 (demanded flow rate), while the pump pressure is controlled at the target pump pressure ap of the target pump pressure setting unit 32 in the region where the flow rate is not saturated. Accordingly, in the operation A in which the input to the control lever unit 5 is slight, the pump pressure is kept at the target pump pressure ap (constant value) corresponding to the lever operation amount in the state in which the pump flow rate does not reach the pump flow rate upper limit aq (demanded flow rate). When the pump flow rate has reached the pump flow rate upper limit aq (demanded flow rate), the pump pressure drops to a pressure that is necessary for maintaining the demanded flow rate and the cylinder speed reaches a speed corresponding to the pump flow rate upper limit aq. Thus, until the cylinder speed reaches the speed corresponding to the pump flow rate upper limit aq, the hydraulic cylinder 4 is driven by force corresponding to the lever operation amount. When the cylinder speed has reached the speed corresponding to the pump flow rate upper limit aq, the pump flow rate is maintained at the pump flow rate upper limit aq and the intended performance can be achieved without wasteful pump flow delivery. In the integral calculation performed by the control amount calculation unit 35, if the responsiveness can be deteriorated by accumulated integral data, it is possible to employ a publicly known technique of specially detecting the saturated state with the limiter 37 and suspending the integral calculation and storing the value at the time of the detection (so-called "anti-windup method"), for example.

In the operation B in which the input to the control lever unit 5 is greater than that in the operation A, the operator's operation amount is relatively large and a value bp higher than the value ap is outputted from the target pump pressure setting unit 32 as the result of the calculation of the target pump pressure. Further, the delivery pressure of the hydraulic pump 2 detected by the pump pressure detector 21 is fed back (feedback subtraction unit 34) and the target tilt amount for setting the pump pressure at the target pump pressure bp is calculated (control amount calculation unit 35). Meanwhile, a value bq higher than the value aq is outputted from the pump flow rate upper limit setting unit 33 as the result of the calculation of the pump flow rate upper limit, and the pump tilt upper limit is determined by correcting the value by use of the revolution speed of the prime mover 1 detected by the revolution detector 22 (revolution speed correction unit 36). The limiter processing is performed by the limiter 37 on the aforementioned target tilt amount by use of the pump tilt upper limit, by which the tilt command for the regulator 2*a* of the hydraulic pump 2 is calculated and the tilt amount of the hydraulic pump 2 is controlled. On the other hand, the directional control valve 3 shown in FIG. 2 has shifted from the neutral position, and thus the delivery flow from the hydraulic pump 2 flows through the meter-in throttle of the directional control valve 3 and is lead to the bottom-side chamber 4*a* of the hydraulic cylinder 4 via the hydraulic line 9A. The hydraulic fluid discharged from the rod-side chamber 4*b* of the hydraulic cylinder 4 flows through the hydraulic line 9B, flows through the meter-out throttle of the directional control valve 3, and is discharged to the tank 15.

In this case, the pump flow rate, the pump pressure and the cylinder speed change as shown in the column "OPERATION B" in FIG. 5 in response to the lever input. Specifically, the pump flow rate is controlled at a flow rate corresponding to the pump flow rate upper limit bq of the hydraulic cylinder 4 (demanded flow rate), while the pump pressure is controlled at the target pump pressure bp of the target pump pressure setting unit 32 in the region where the flow rate is not saturated. Accordingly, in the operation B in which the input to the control lever unit 5 is relatively large, the pump pressure is kept at the target pump pressure bp (constant value) corresponding to the lever operation amount in the state in which the pump flow rate does not reach the pump flow rate upper limit bq (demanded flow rate). When the pump flow rate has reached the pump flow rate upper limit bq (demanded flow rate), the pump pressure drops to a pressure that is necessary for maintaining the demanded flow rate and the cylinder speed reaches a speed corresponding to the pump flow rate upper limit bq. Thus, until the cylinder speed reaches the speed corresponding to the pump flow rate upper limit bq, the hydraulic cylinder 4 is driven by force corresponding to the lever operation amount. When the cylinder speed has reached the speed corresponding to the pump flow rate upper limit bq, the pump flow rate is maintained at the pump flow rate upper limit bq and the intended performance can be achieved without wasteful pump flow delivery. Similarly to the case of the above-described operation A, if the responsiveness can be deteriorated by accumulated integral data in the integral calculation performed by the control amount calculation unit 35, it is possible to employ the publicly known technique of specially detecting the saturated state with the limiter 37 and suspending the integral calculation and storing the value at the time of the detection (so-called "anti-windup method"), for example.

While the above explanation has been given about two operation amounts (operation A and operation B), the advantage of achieving the intended performance without wasteful pump flow delivery can be obtained similarly in all operation ranges.

As described above, according to this embodiment, the energy efficiency can be increased by suppressing the discharging of the delivery flow of the hydraulic pump 2 by the bleed-off control and reducing the throttle/relief loss in the delivery flow of the hydraulic pump 2, while also making it possible to control the delivery pressure of the hydraulic pump 2 according to the operation amount of the control lever unit 5 and improving the operational performance.

Second Embodiment

Figure 6:
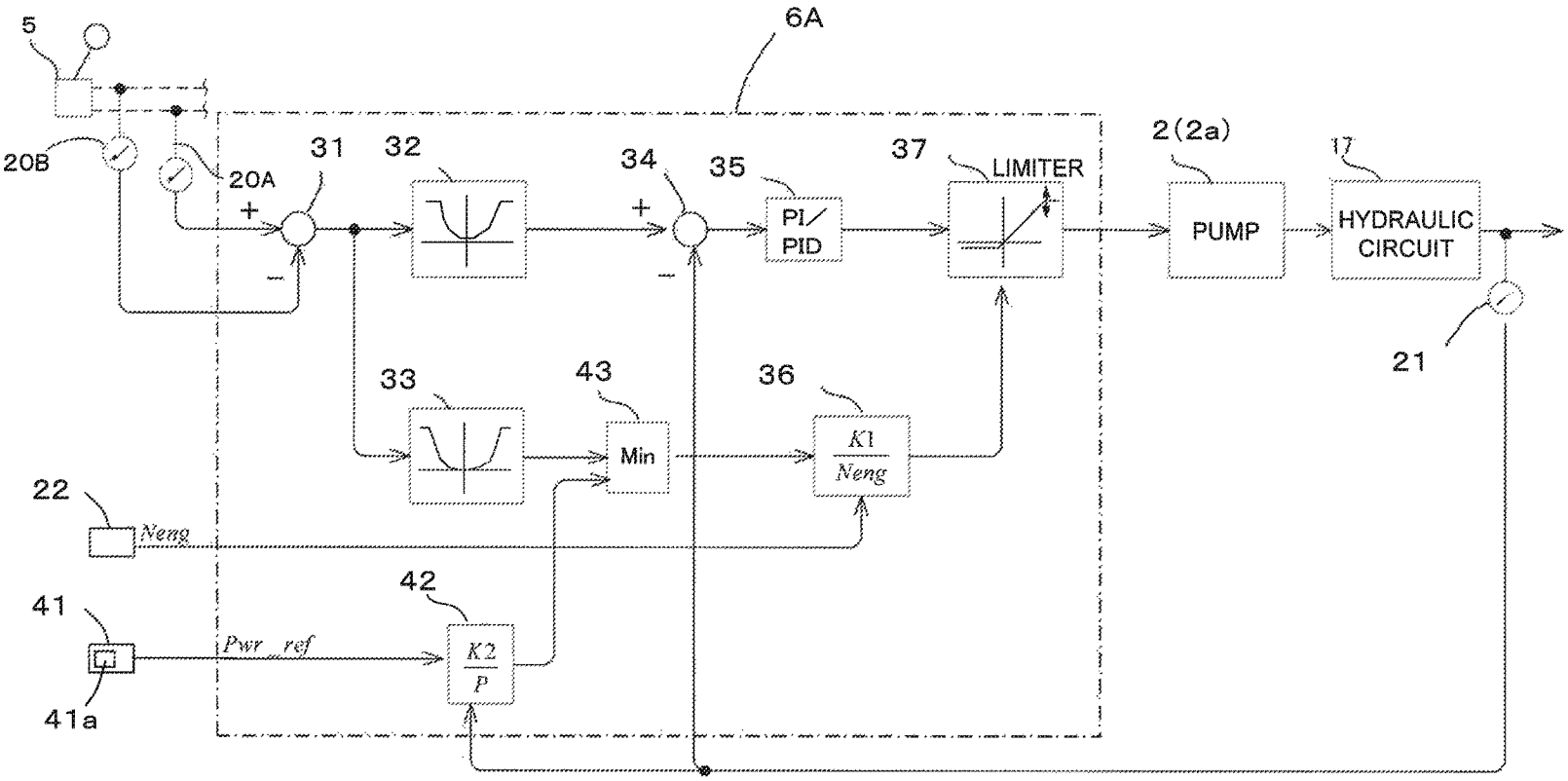
FIG. 6 is a schematic diagram showing the control logic of a controller of a hydraulic control device in accordance with a second embodiment of the present invention.

FIG. 6 is a schematic diagram showing the control logic of a controller of a hydraulic control device in accordance with a second embodiment of the present invention. Elements in FIG. 6 identical with those in the first embodiment are assigned the same reference characters and repeated explanation thereof is omitted for brevity.

Referring to FIG. 6, the controller 6A in this embodiment includes a pump power upper limit setting device 41, a flow rate correction unit 42 (flow rate upper limit correction unit) and a lower-side selection unit 43 (selection unit) in addition to the configuration shown in FIG. 3. The pump power upper limit setting device 41 sets a power limit value Pwr_ref for limiting the absorption power of the hydraulic pump 2. The flow rate correction unit 42 (flow rate upper limit correction unit) calculates a pump flow rate upper limit by dividing the power limit value Pwr_ref set by the pump power upper limit setting device 41 by the delivery pressure of the hydraulic pump 2 (present pressure) detected by the pressure detector 21 and multiplying the quotient by a correction coefficient K2. The lower-side selection unit 43 (selection unit) selects the lower value from the pump flow rate upper limit calculated by the pump flow rate upper limit setting unit 33 and the pump flow rate upper limit calculated by the flow rate correction unit 42. The pump flow rate upper limit selected by the lower-side selection unit 43 is inputted to the revolution speed correction unit 36, by which the pump tilt upper limit is calculated.

The pump power upper limit setting device 41 includes an operating device 41*a*. The operator can freely change the power limit value Pwr_ref by operating the operating device 41*a*.

As above, the lower value is selected from the pump flow rate upper limit determined from the operation amount signal from the operation amount detector 20A/20B (lever operation amount) and the pump flow rate upper limit from the pump power upper limit setting device 41 and the tilt amount of the hydraulic pump 2 is controlled based on the selected pump flow rate upper limit. This makes it possible to perform the control while incorporating the power of the hydraulic pump 2 into the limitation placed in the first embodiment.

Since this control suppresses the discharging of the pump delivery flow such as the bleeding off, the pump delivery flow rate and the pressure can be controlled while securing excellent energy efficiency and improving the operational performance. In addition, the operational performance of the system can be improved further since the power of the hydraulic pump 2 can be limited.

Figure 7:
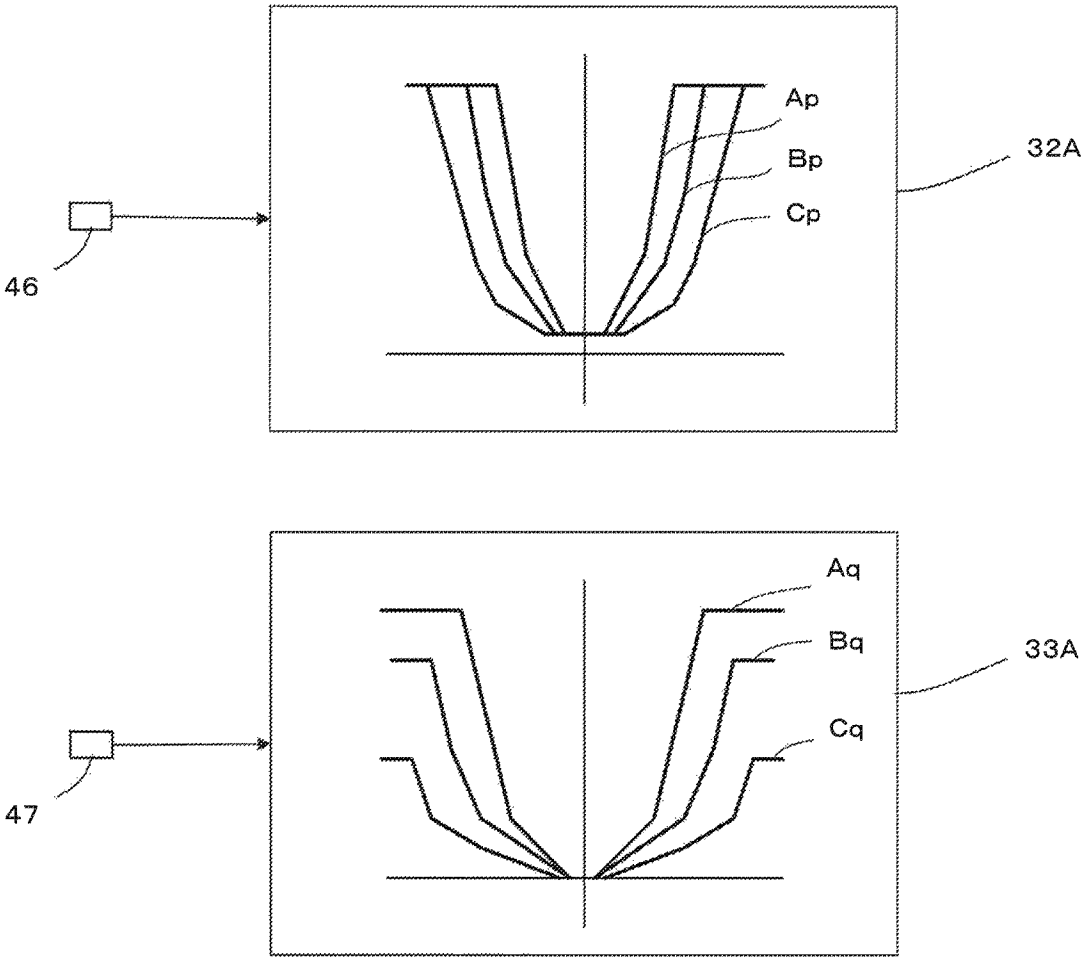
FIG. 7 is a graph showing a modification of the target pump pressure setting unit and the pump flow rate upper limit setting unit in the first and second embodiments.

FIG. 7 is a graph showing a modification of the target pump pressure setting unit and the pump flow rate upper limit setting unit in the first and second embodiments. In the first and second embodiments, one relationship between the operation amount signal and the target pump pressure (hereinafter referred to as a "target pump pressure characteristic") is set in the target pump pressure setting unit 32 and one relationship between the operation amount signal and the pump flow rate upper limit (hereinafter referred to as a "pump flow rate upper limit characteristic") is set in the pump flow rate upper limit setting unit 33. In the modification shown in FIG. 7, multiple target pump pressure characteristics Ap, Bp and Cp are set in a target pump pressure setting unit 32A and multiple pump flow rate upper limit characteristics Aq, Bq and Cq are set in a pump flow rate upper limit setting unit 33A. The operator can select a desired characteristic by operating an operating device 46 or 47.

With this configuration, the operator is allowed to freely adjust the target pump pressure characteristic and the pump flow rate upper limit characteristic according to his/her intention. Consequently, the operational performance is improved further.

Figure 8:
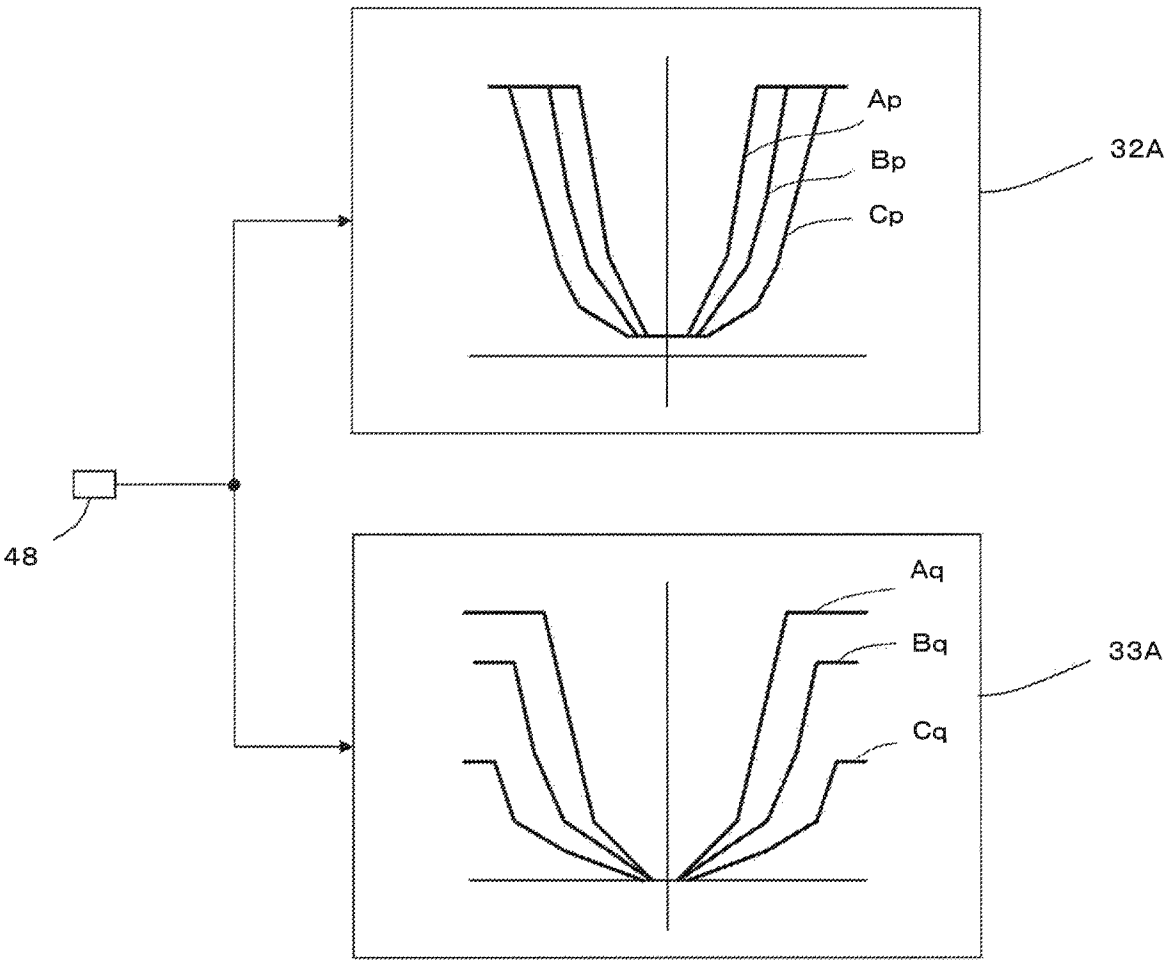
FIG. 8 is a graph showing another modification of the target pump pressure setting unit and the pump flow rate upper limit setting unit in the first and second embodiments.

FIG. 8 is a graph showing another modification of the target pump pressure setting unit and the pump flow rate upper limit setting unit in the first and second embodiments. In this modification, the target pump pressure setting unit 32A and the pump flow rate upper limit setting unit 33A in the above modification shown in FIG. 7 are configured to allow for selection from three modes: a high power mode, a standard mode and a fine operation mode. In the high power mode, the power and the speed are set relatively high by combining the characteristic Ap (in which the target pump pressure with respect to the operation amount signal in the target pump pressure setting unit 32A is set at a high set value) with the characteristic Aq (in which the pump flow rate upper limit with respect to the operation amount signal in the pump flow rate upper limit setting unit 33A is set at a high set value). In the standard mode, the characteristic Bp (in which the target pump pressure with respect to the operation amount signal in the target pump pressure setting unit 32A is set at an intermediate set value) is combined with the characteristic Bq (in which the pump flow rate upper limit with respect to the operation amount signal in the pump flow rate upper limit setting unit 33A is set at an intermediate set value). In the fine operation mode, the characteristic Cp (in which the target pump pressure with respect to the operation amount signal in the target pump pressure setting unit 32A is set at a low set value) is combined with the characteristic Cq (in which the pump flow rate upper limit with respect to the operation amount signal in the pump flow rate upper limit setting unit 33A is set at a low set value). The operator can select a desired mode by operating an operating device 48.

With this configuration, in the situation in which there are a lot of combinations of characteristics of the target pump pressure setting unit 32A and the pump flow rate upper limit setting unit 33A, the operator is allowed to make the complicated settings just by making a selection from some typical combinations (modes). Thus, the operation for selecting a combination is simplified, the workload on the operator is reduced, and the usability is improved.

Figure 9:
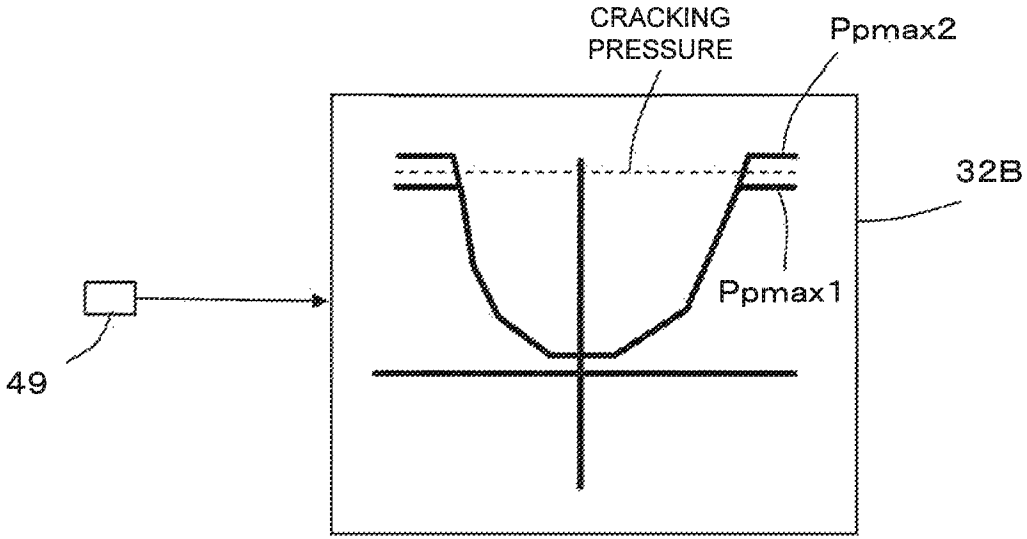
FIG. 9 is a graph showing still another modification of the target pump pressure setting unit in the first and second embodiments.

FIG. 9 is a graph showing still another modification of the target pump pressure setting unit in the first and second embodiments. In this modification, a pressure Ppmax1 lower than the opening pressure (cracking pressure) of the main relief valve 8 and a pressure Ppmax2 higher than the opening pressure (cracking pressure) of the main relief valve 8 are previously set in a target pump pressure setting unit 32B as the maximum pressure of the target pump pressure. The operator can select one of the pressures Ppmax1 and Ppmax2 by operating an operating device 49.

As already explained by referring to FIG. 3A, the target pump pressure setting unit 32 in the first and second embodiments has been preset so that the delivery pressure of the hydraulic pump 2 increases with the increase in the operation amount signal from the operation amount detector 20A/20B (operation amount of the control lever unit 5). The target pump pressure setting unit 32 is configured so as to secure the maximum circuit pressure when the control lever unit 5 is around or over the maximum lever operation position and so as to suppress the circuit pressure to a low level when the control lever unit 5 is around the neutral position. From the viewpoint of increasing the energy efficiency, the set value of the maximum circuit pressure, which is secured when the control lever unit 5 is around or over the maximum lever operation position, has been set lower than the opening pressure (cracking pressure) of the main relief valve 8 which limits the delivery pressure of the hydraulic pump 2. With this setting, the limitation on the circuit pressure is conducted basically by the control of the delivery flow rate of the hydraulic pump 2. Therefore, energy loss due to the opening of the main relief valve 8 decreases and the energy efficiency increases.

In contrast, in cases where the engine 1 is started when the temperature is low (e.g., in winter) and the hydraulic fluid and the equipment in the hydraulic circuit has to be warmed up, it is effective to set the set value of the maximum circuit pressure higher than the opening pressure (cracking pressure) of the main relief valve 8 which limits the delivery pressure of the hydraulic pump 2. This is because operating the control lever unit 5 so as to press against the stroke end of the hydraulic cylinder 4 causes the delivery flow of the hydraulic pump 2 to reach the relief pressure and part of the delivery flow of the hydraulic pump 2 is released through the main relief valve 8 and converted into heat to warm up the hydraulic fluid.

This modification achieves such two objects. Specifically, in normal use, the maximum delivery pressure of the hydraulic pump 2 can be made lower than the cracking pressure of the main relief valve 8 by setting the pressure Ppmax1 in the target pump pressure setting unit 32 as the maximum pressure of the target pump pressure. This setting reduces the energy loss due to the opening of the main relief valve 8 and increases the energy efficiency. In low temperature conditions or the like, the maximum delivery pressure of the hydraulic pump 2 can be made higher than the cracking pressure of the main relief valve 8 by setting the pressure Ppmax2 in the target pump pressure setting unit 32 as the maximum pressure of the target pump pressure. With this setting, the delivery pressure of the hydraulic pump 2 reaches the relief pressure, part of the delivery flow of the hydraulic pump 2 is released through the main relief valve 8 and converted into heat, and the hydraulic fluid can be warmed up.

Third Embodiment

Figure 10:
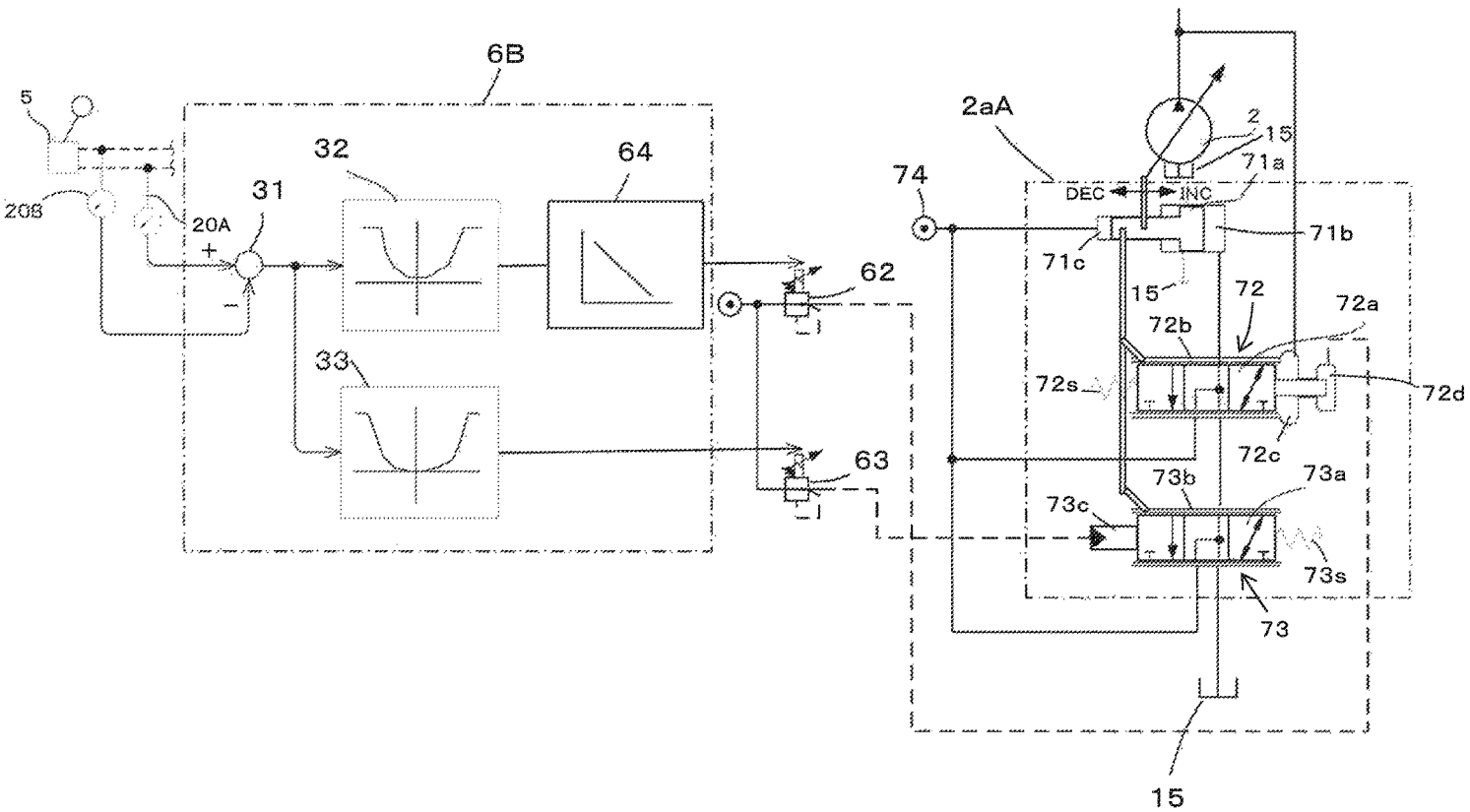
FIG. 10 is a schematic diagram showing the configuration of a pump control device and the control logic of a controller in a hydraulic control device in accordance with a third embodiment of the present invention.

FIG. 10 is a schematic diagram showing the configuration of a pump control device and the control logic of a controller in a hydraulic control device in accordance with a third embodiment of the present invention. Elements in FIG. 10 identical with those in the first embodiment are assigned the same reference characters and repeated explanation thereof is omitted for brevity.

In the first embodiment, all functions till the determination of the target tilt amount of the hydraulic pump 2 are assigned to the controller 6 and conducted by software, and the function of setting the tilt amount of the hydraulic pump 2 at the target tilt amount determined by the controller 6 is assigned to the mechanical regulator 2*a*. In this embodiment, the functions of the target pump pressure setting unit 32 and the pump flow rate upper limit setting unit 33 are assigned to a controller 6B, and the other processing functions (functions of the feedback subtraction unit 34, the control amount calculation unit 35 and the limiter 37) as the functions of the pressure control system are assigned to a mechanical regulator 2*a*A.

Referring to FIG. 10, the pump control device in this embodiment includes the controller 6B, the regulator 2*a*A, and solenoid proportional valves 62 and 63.

The controller 6B includes an operation amount detection unit 31, a target pump pressure setting unit 32, a pump flow rate upper limit setting unit 33 and an inversion unit 64. The operation amount detection unit 31, the target pump pressure setting unit 32 and the pump flow rate upper limit setting unit 33 are identical with those in the controller 6 in the first embodiment. The inversion unit 64 calculates a value that decreases with the increase in the target pump pressure calculated by the target pump pressure setting unit 32 and outputs the calculated value as a control signal for the solenoid proportional valve 62. Meanwhile, the pump flow rate upper limit setting unit 33 outputs the calculated pump flow rate upper limit as a control signal for the solenoid proportional valve 63.

The controller 6B may also be configured to further include the revolution speed correction unit 36 similarly to the controller 6 in FIG. 3 so as to correct the pump flow rate upper limit (calculated by the pump flow rate upper limit setting unit 33) based on the revolution speed of the prime mover 1 (detected by the revolution detector 22) by dividing the pump flow rate upper limit by the revolution speed Neng of the prime mover 1 and multiplying the quotient by the correction coefficient K1. The controller 6B may also be configured to further include the flow rate correction unit 42 and the lower-side selection unit 43 similarly to the controller 6A in FIG. 6 so as to calculate the pump tilt upper limit by selecting the lower value from the pump flow rate upper limit calculated by the pump flow rate upper limit setting unit 33 and the pump flow rate upper limit calculated from the power limit value Pwr_ref set by the pump power upper limit setting device 41.

The regulator 2$a$A includes a servo piston device 71, a pressure control spool valve 72 and a flow control spool valve 73. The servo piston device 71 includes a piston 71$a$, a large-diameter cylinder chamber 71$b$ and a small-diameter cylinder chamber 71$c$. The piston 71$a$ is linked to the swash plate of the hydraulic pump 2. The large-diameter cylinder chamber 71$b$ is connected to a pilot hydraulic pressure source 74 and the tank 15 via the pressure control spool valve 72 and the flow control spool valve 73. The small-diameter cylinder chamber 71$c$ is directly connected to the pilot hydraulic pressure source 74. The pressure control spool valve 72 includes a spool 72$a$, a sleeve 72$b$ which forms a valve port, a pressure-receiving chamber 72$c$ to which the delivery pressure of the hydraulic pump 2 (self pressure) is lead, and a pressure-receiving chamber 72$d$ to which control pressure outputted by the solenoid proportional valve 62 is lead as an external pilot signal. The flow control spool valve 73 includes a spool 73$a$, a sleeve 73$b$ which forms a valve port, a spring 73$c$, and a pressure-receiving chamber 73$d$ to which control pressure outputted by the solenoid proportional valve 63 is lead as an external pilot signal. The sleeve 72$b$ of the pressure control spool valve 72 and the sleeve 73$b$ of the flow control spool valve 73 are linked to the piston 71$a$ of the servo piston device 71 so that the displacement (shift amount) of the piston 71$a$ is fed back by a mechanical configuration. Thus, the regulator 2$a$A has high positional control performance in regard to the displacement (shift amount) of the spools 72$a$ and 73$a$ even though being configured mechanically.

The combination of the controller 6B and the regulator 2$a$A configured as above is functionally equivalent to the first and second embodiments except for the absence of the prime mover revolution speed correction function of the revolution speed correction unit 36. Further, the functions of the pressure control system of the controller 6 in the first and second embodiments can be implemented by a mechanical regulator 2$a$A.

According to this embodiment, high-responsiveness high-precision control such as the pressure control is carried out by a mechanical regulator 2$a$A. Therefore, control with high responsiveness can be achieved even if the controller 6B does not have high performance necessary for high-speed control calculation. Further, the configuration of this embodiment is desirable since it offers greater flexibility in combining components and the system configuration is facilitated.

DESCRIPTION OF REFERENCE CHARACTERS

1 prime mover (diesel engine)
2 hydraulic pump of the variable displacement type
2$a$, 2$a$A regulator
3 directional control valve
4 actuator
5 control lever unit
6, 6A, 6B controller
7 pump delivery hydraulic line
8 main relief valve
9A, 9B hydraulic line
10A, 10B overload relief valve
11A, 11B supply check valve
15 tank
20A, 20B operation amount detector (pressure detector)
21 pressure detector
22 revolution detector
31 operation amount detection unit
32 target pump pressure setting unit
33 pump flow rate upper limit setting unit
34 feedback subtraction unit
35 control amount calculation unit
36 revolution speed correction unit
37 limiter (control amount limitation unit)
41 pump power upper limit setting device
42 flow rate correction unit
43 lower-side selection unit
62, 63 solenoid proportional valve
64 inversion unit
71 servo piston device
71$a$ piston
71$b$ large-diameter cylinder chamber
71$c$ small-diameter cylinder chamber
72 pressure control spool valve
72$a$ spool
72$b$ sleeve
72$c$ pressure-receiving chamber
72$d$ pressure-receiving chamber
73 flow control spool valve
73$a$ spool
73$b$ sleeve
73$c$ spring
73$d$ pressure-receiving chamber
74 pilot hydraulic pressure source
101 track structure
102 swing structure
103 work device (front work implement)
104 boom
105 arm
106 bucket
107 boom cylinder
108 arm cylinder
109 bucket cylinder
110 cab
111$a$, 111$b$ crawler
112$a$, 112$b$ travel motor

The invention claimed is:

1. A hydraulic control device for a work machine, comprising:

a prime mover;

a hydraulic pump of the variable displacement type which is driven by the prime mover;

a hydraulic actuator which is driven by hydraulic fluid delivered from the hydraulic pump;

a directional control valve which controls the flow of the hydraulic fluid supplied from the hydraulic pump to the hydraulic actuator;

a control lever unit through which an operator inputs operation commands;

an operation amount detector which detects the operation amount of the control lever unit;

a pressure detector which detects the delivery pressure of the hydraulic pump; and a pump control device which includes:

a target pump pressure setting unit which calculates a target pump delivery pressure which increases with the increase in an operation amount signal from the operation amount detector based on the operation amount signal from the operation amount detector;

a pump flow rate upper limit setting unit which calculates a pump flow rate upper limit which increases with the increase in the operation amount signal from the operation amount detector based on the operation amount signal from the operation amount detector; wherein a tilt amount of the hydraulic pump is based on the target pump delivery pressure calculated by the target pump pressure setting unit and the delivery pressure of the hydraulic pump detected by the pressure detector, wherein the hydraulic control device further comprises a prime mover revolution detector which detects the revolution speed of the prime mover, the pump control device further includes a revolution speed correction unit which calculates a pump tilt upper limit by correcting the pump flow rate upper limit by use of the revolution speed of the prime mover detected by the prime mover revolution detector, and a control amount limitation unit limits an upper limit of the tilt amount of the hydraulic pump based on the pump tilt upper limit calculated by the revolution speed correction unit; and a tilt amount control unit which controls the hydraulic pump based on the upper limit of the tilt amount.

2. The hydraulic control device for a work machine according to claim 1, further comprising:

a pump power upper limit setting device which sets a power limit value for limiting the absorption power of the hydraulic pump;

a flow rate upper limit correction unit which calculates a pump flow rate upper limit by correcting the power limit value set by the pump power upper limit setting device by use of the delivery pressure of the hydraulic pump detected by the pressure detector; and a selection unit which compares the pump flow rate upper limit calculated by the pump flow rate upper limit setting unit with the pump flow rate upper limit calculated by the flow rate upper limit correction unit and selects the lower value from the two pump flow rate upper limits, wherein the revolution speed correction unit uses the pump flow rate upper limit selected by the selection unit.

3. The hydraulic control device for a work machine according to claim 2, wherein the pump power upper limit setting device is configured to allow the operator to change the power limit value by operating an operating device.

4. The hydraulic control device for a work machine according to claim 1, wherein the target pump pressure setting unit is configured to have multiple target pump pressure characteristics preset therein and to allow the operator to select a desired one of the target pump pressure characteristics by operating an operating device.

5. The hydraulic control device for a work machine according to claim 1, wherein the pump flow rate upper limit setting unit is configured to have multiple pump flow rate upper limit characteristics preset therein and to allow the operator to select a desired one of the pump flow rate upper limit characteristics by operating an operating device.

6. The hydraulic control device for a work machine according to claim 1, wherein the target pump pressure setting unit and the pump flow rate upper limit setting unit have:

a high power mode in which a characteristic in which the target pump pressure with respect to the operation amount signal in the target pump pressure setting unit is set at a high set value is combined with a characteristic in which the pump flow rate upper limit with respect to the operation amount signal in the pump flow rate upper limit setting unit is set at a high set value;

a standard mode in which a characteristic in which the target pump pressure with respect to the operation amount signal in the target pump pressure setting unit is set at an intermediate set value is combined with a characteristic in which the pump flow rate upper limit with respect to the operation amount signal in the pump flow rate upper limit setting unit is set at an intermediate set value; and a fine operation mode in which a characteristic in which the target pump pressure with respect to the operation amount signal in the target pump pressure setting unit is set at a low set value is combined with a characteristic in which the pump flow rate upper limit with respect to the operation amount signal in the pump flow rate upper limit setting unit is set at a low set value, wherein the hydraulic control device is configured to allow the operator to select a desired mode by operating an operating device.

7. The hydraulic control device for a work machine according to claim 1, further comprising a main relief valve which is connected to a pump delivery hydraulic line connecting the hydraulic pump to the directional control valve and prescribes the upper limit of the pressure in the pump delivery hydraulic line, wherein:

the target pump pressure setting unit is configured to set a pressure Ppmax1 lower than opening pressure of the main relief valve or a pressure Ppmax2 higher than the opening pressure of the main relief valve as the maximum pressure of the target pump pressure, and the hydraulic control device is configured to allow the operator to select one of the pressures Ppmax1 and Ppmax2 by operating an operating device.

* * * * *